US011662105B2

(12) United States Patent
Suvvada et al.

(10) Patent No.: US 11,662,105 B2
(45) Date of Patent: May 30, 2023

(54) ELECTRICAL HOUSING FOR HEATING, VENTILATION, AND/OR AIR CONDITIONING (HVAC) SYSTEM

(71) Applicant: Johnson Controls Technology Company, Auburn Hills, MI (US)

(72) Inventors: Gnanesh Suvvada, Vizianagaram (IN); Bhushan D. Vichare, Sangli (IN); Ganesh Ashok Wargantiwar, Pune (IN); Pavan Reva Mahajan, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 156 days.

(21) Appl. No.: 17/162,926

(22) Filed: Jan. 29, 2021

(65) Prior Publication Data

US 2021/0239332 A1 Aug. 5, 2021

(51) Int. Cl.
*F24F 1/56* (2011.01)

(52) U.S. Cl.
CPC ..... *F24F 1/56* (2013.01)

(58) Field of Classification Search
CPC ..... F24F 1/56; F24F 1/22; F24F 1/46; F24F 1/20; F25D 29/005
USPC ..... 62/259.1
See application file for complete search history.

(56) References Cited

U.S. PATENT DOCUMENTS

| | | | | |
|---|---|---|---|---|
| 6,445,585 | B1 | 9/2002 | Walker | |
| 11,293,653 | B1 * | 4/2022 | Burnett | F24F 8/10 |
| 2016/0106008 | A1 * | 4/2016 | Cotton | H05K 7/20836 62/304 |
| 2020/0158355 | A1 * | 5/2020 | Chu | F24F 1/06 |

FOREIGN PATENT DOCUMENTS

| | | | |
|---|---|---|---|
| JP | 07274318 | A * | 10/1995 |
| JP | H-07274318 | A * | 10/1995 |
| JP | H7274318 | A | 10/1995 |
| WO | 2019175791 | A1 | 9/2019 |

OTHER PUBLICATIONS

Attached pdf file is translation of foreign reference JPH 07274318 A (Year: 1995).*
Pdf is translation of foreign reference JP-07274318-A (Year: 1995).*

* cited by examiner

*Primary Examiner* — Henry T Crenshaw
*Assistant Examiner* — Kamran Tavakoldavani
(74) *Attorney, Agent, or Firm* — Fletcher Yoder, P.C.

(57) ABSTRACT

A heating, ventilation, and/or air conditioning (HVAC) unit includes a housing having a base wall, a first electrical component coupled to the base wall, a panel movably coupled to the housing and configured to transition between a closed configuration that defines an air gap between the panel and the base wall and that blocks access to the first electrical component and an open configuration that enables access to the first electrical component, and a second electrical component coupled to the panel. The second electrical component is disposed on a side of the panel opposite the air gap in the closed configuration of the panel.

20 Claims, 8 Drawing Sheets

ELECTRICAL HOUSING FOR HEATING, VENTILATION, AND/OR AIR CONDITIONING (HVAC) SYSTEM

CROSS REFERENCE TO RELATED APPLICATIONS

This application claims priority from and the benefit of India Provisional Application Serial No. 202011004416, entitled "ELECTRICAL HOUSING FOR HEATING VENTILATION AND/OR AIR CONDITIONING (HVAC) SYSTEM," filed Jan. 31, 2020, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include various electrical components configured to operate the HVAC system. Some of these electrical components may be high voltage components, and other electrical components may be low voltage components. In conventional approaches, the HVAC system may include separate housing areas for high voltage electrical components and low voltage electrical components. For example, a housing of the HVAC system may include substantial and separate portions that each respectively accommodate high voltage or low voltage electrical components. It is now recognized that there is a need to improve the arrangement and efficiency of such systems.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) unit includes a housing having a base wall, a first electrical component coupled to the base wall, a panel movably coupled to the housing and configured to transition between a closed configuration that defines an air gap between the panel and the base wall and that blocks access to the first electrical component and an open configuration that enables access to the first electrical component, and a second electrical component coupled to the panel. The second electrical component is disposed on a side of the panel opposite the air gap in the closed configuration of the panel.

In one embodiment, a heating, ventilation, and/or air conditioning (HVAC) unit includes a base wall coupled to a side wall, a high voltage power component coupled to the base wall, and a panel coupled to the side wall. The panel is configured to transition between a closed configuration that occludes the base wall from an exterior of the HVAC unit and an open configuration that exposes the base wall to the exterior of the HVAC unit, and an air gap spans between the panel and the high voltage power component in the closed configuration of the panel. The HVAC system also includes a low voltage control component coupled to the panel and disposed on a side of the panel opposite the air gap in the closed configuration of the panel.

In one embodiment, a heating, ventilation, and/or air conditioning (HVAC) system includes a plurality of walls forming a recess in a housing of the HVAC system, high voltage power components coupled to a first wall of the plurality of walls, a panel rotatably coupled to a second wall of the plurality of walls. The panel is configured to rotate between a closed configuration that blocks access to an interior of the recess and an open configuration that enables access to the interior of the recess, and the panel is offset from the first wall to form an air gap between the panel and the first wall in the closed configuration of the panel. The HVAC system also includes low voltage control components coupled to an exterior surface of the panel that is opposite the air gap in the closed configuration of the panel.

BRIEF DESCRIPTION OF THE DRAWINGS

Various aspects of this disclosure may be better understood upon reading the following detailed description and upon reference to the drawings in which.

DETAILED DESCRIPTION

Figure 1:
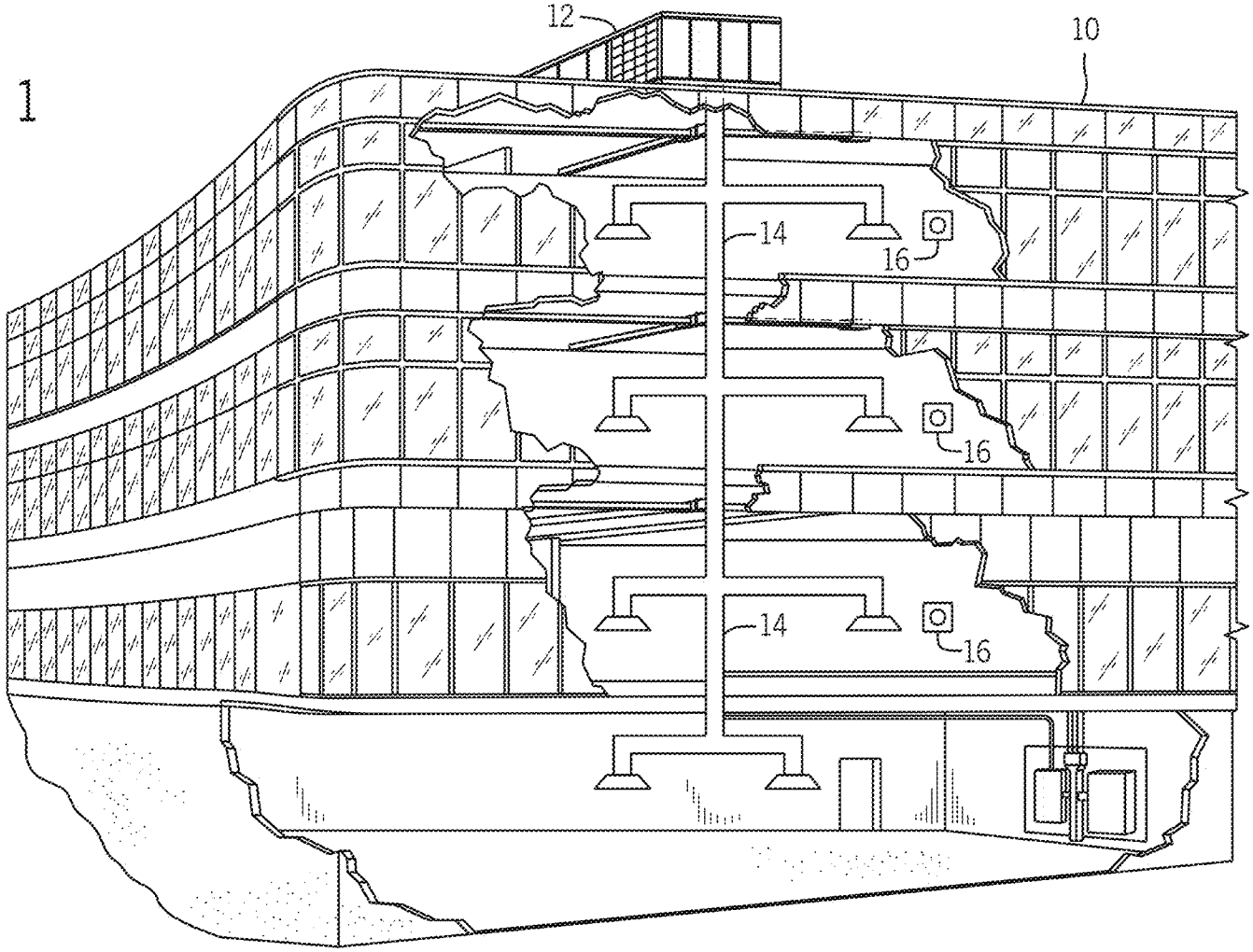
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system and to electrical housing features of such an HVAC system. The HVAC system may utilize a heat exchanger for transferring heat or thermal energy between a fluid, such as an air flow, and a refrigerant flowing through the HVAC system, thereby conditioning the fluid. For example, the refrigerant may be used to absorb thermal energy from the fluid to cool the fluid. The cooled fluid may then be directed into a structure (e.g., a room) conditioned by the HVAC system so as to cool an interior of the structure. The HVAC system may include an electrical system configured to enable operation of the HVAC system. Portions of the electrical system (e.g., controllers) may be disposed within an electrical section or housing. As used herein, the electrical section refers to any housing section of the HVAC system designated for placement of electrical components that facilitate operation of the HVAC system. The electrical section may include low voltage components and/or high voltage components.

The low voltage components and high voltage components of the HVAC system may be separated from one another to avoid interference therebetween and thereby mitigate potential impact on electrical communication and performance of such components. Standards, such as the Underwriter Laboratories (UL) 508 Standard, may designate components as either high voltage or low voltage and may dictate that HVAC systems satisfy certain separation guidelines for such components. Low voltage components, such as a low voltage control board, may be configured to control and/or regulate operation of other components of the HVAC system. For example, the low voltage components may control operation of control valves to manage fluid flow through the heat exchanger. In contrast, high voltage components may be configured to receive, distribute, and/or generate power for the HVAC system to enable other components of the HVAC system to function using high voltage. For example, the high voltage components may include a motor and/or a motor starter that enables a compressor of the HVAC system to pressurize the refrigerant and drive the refrigerant through the HVAC system. As such, the low voltage components and high voltage components operate in conjunction with one another to enable operation of the HVAC system.

It may be desirable to physically separate the low voltage components from the high voltage components to avoid interference between their respective operations. In certain approaches, the low voltage components and the high voltage components may be offset from one another along a longitudinal axis (e.g., a length) of the HVAC system, and a structural barrier may be positioned between the components. For example, the low voltage components may be positioned within a recess of a housing of the HVAC system at a first location within the HVAC system, and the high voltage components may be positioned within another recess of the housing at a different, second location within the HVAC system. As such, the housing of the HVAC system may be manufactured to accommodate the positioning of both the low voltage components and the high voltage components in separate recesses or compartments, such as by increasing a size or length of the housing of the HVAC system. Further, separate panels or doors may be installed to separately control access to these compartments. For instance, respective panels may be used to enable or block access to the separate components. In this manner, a cost associated with manufacturing the HVAC system may be increased to accommodate the separate low voltage components and high voltage components.

It is presently recognized that implementing the low voltage components and the high voltage components in an HVAC system without substantially increasing the length or size of the HVAC system may reduce the cost associated with manufacture of the HVAC system. Accordingly, present embodiments reduce a physical footprint of the HVAC system and increase a space efficiency (e.g., improve space utilization) by housing both low voltage components and high voltage components within a space having a reduced size, while maintaining a desired separation by using an arrangement of support surfaces for the components. For example, an embodiment of the present disclosure includes the low voltage components coupled to a panel and the high voltage components coupled to a wall, in which the panel is offset from the wall along a lateral axis of the HVAC system instead of along the longitudinal axis of the HVAC system, thereby avoiding an increase in the length of the HVAC system. In this manner, the low voltage components and the high voltage components may be positioned at a substantially common point along the length of the HVAC system, but the components may be offset from one another along the width of the HVAC system. Additionally, in accordance with present techniques, the width of the HVAC system may not be increased to accommodate such positioning of the low voltage components and the high voltage components. For example, a recess may be formed into the housing of the HVAC system to accommodate both the low voltage components and the high voltage components coupled to the panel and the wall, respectively, and the recess may extend to be adjacent to a plenum of the HVAC system. Thus, an overall size of the HVAC system may be reduced or more efficiently utilized, thereby reducing a cost associated with manufacture of the HVAC system. Further, the panel may be movable relative to the housing of the HVAC system to enable or block access to the wall. As such, the arrangement of the panel and the wall may enable efficient and separate access to both the low voltage components and the high voltage components without utilizing separate doors, further reducing a cost associated with the manufacture of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
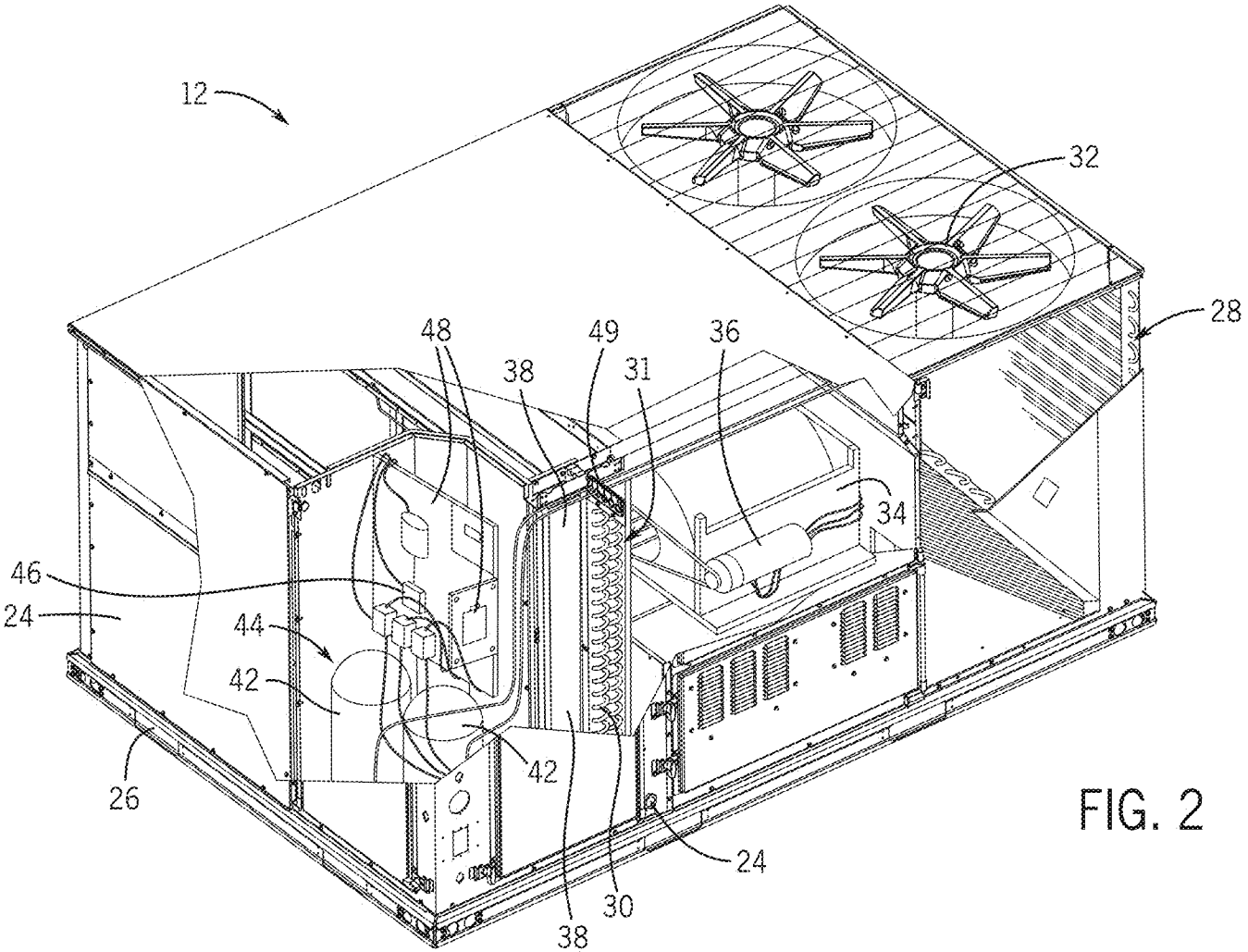
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
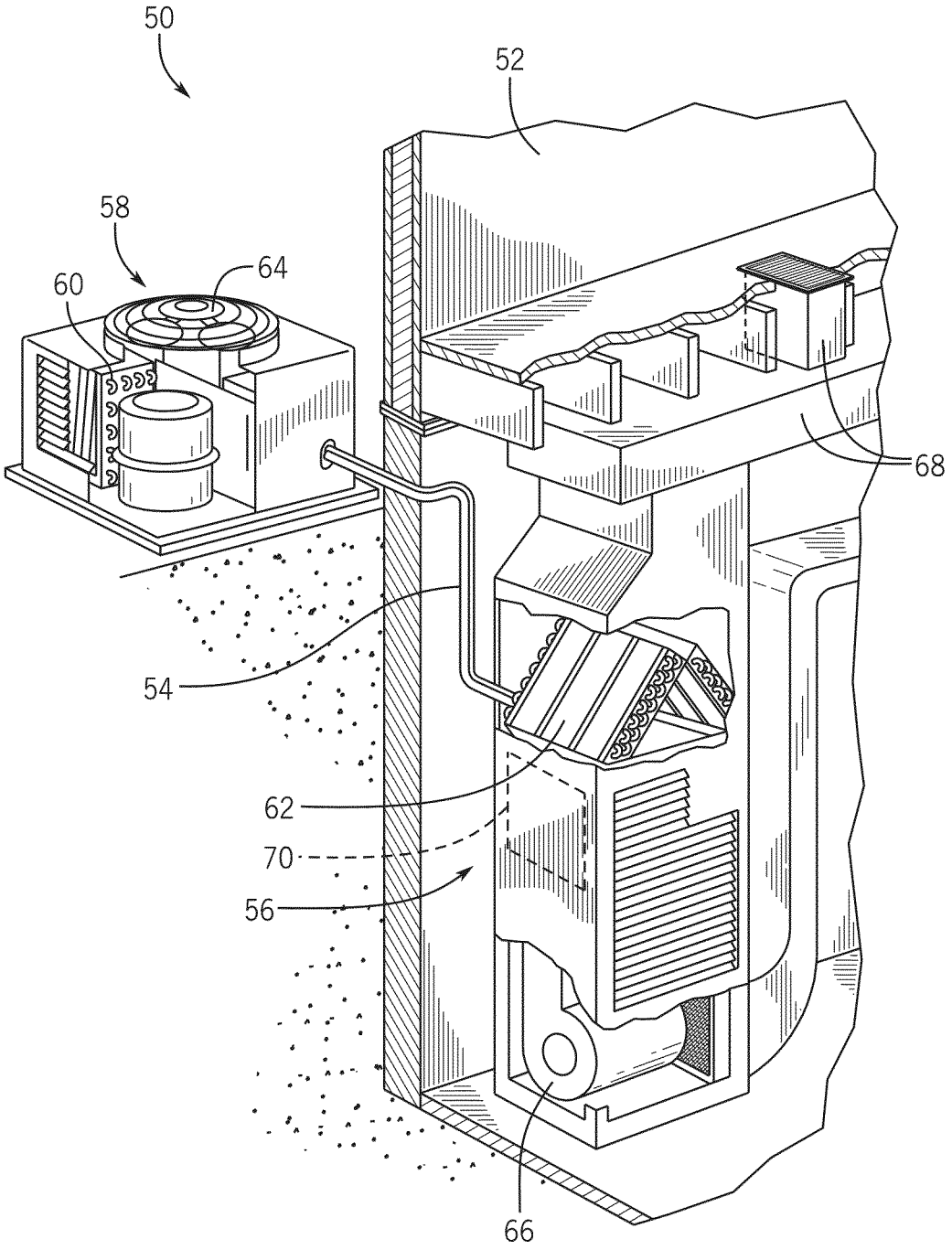
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
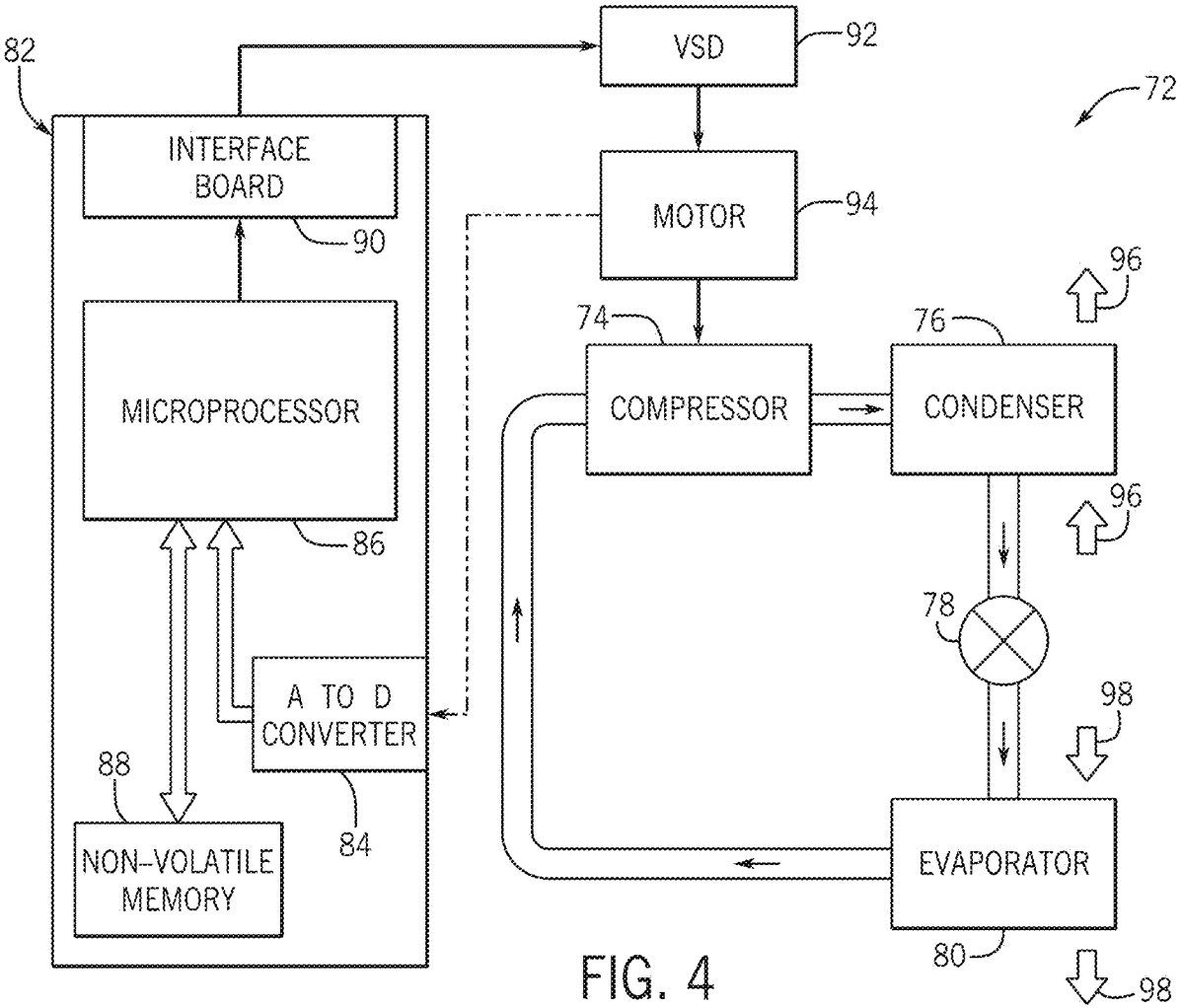
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Embodiments of the present disclosure are directed to an electrical section of an HVAC system in which high voltage components (e.g., high voltage power components) of the HVAC system are positioned offset relative to low voltage components (e.g., low voltage control components) of the HVAC system, thereby defining or forming an air gap (e.g., at least an 8 inch air gap) between the high voltage components and the low voltage components. For instance, the HVAC system may include a housing that has a recess, and the high voltage components may be coupled to a wall positioned within the recess. In addition, the low voltage components may be coupled to a panel that is located more exterior relative to the wall. The panel may be movable relative to the housing. That is, the panel may support the low voltage components and may also operate as a doorway to the high voltage components. For example, the panel may be translatable (e.g., linearly translatable or rotatable about a hinge) between a first configuration or position, which substantially covers or occludes the high voltage components, and a second configuration or position, which substantially exposes the high voltage components to an exterior of the housing. As an example, in the first configuration of the panel, the low voltage components may be accessible at the exterior of the housing while the high voltage components are inaccessible. In the second configuration of the panel, the high voltage components may be accessible at the exterior of the housing. As a result, present embodiments of the HVAC system enable improved accessibility of the electrical section. It should be noted that a barrier may also be coupled to the housing, such that the panel supporting the low voltage components is positioned between the barrier and the high voltage components. The barrier may enable control of access to both sets of components.

Figure 5:
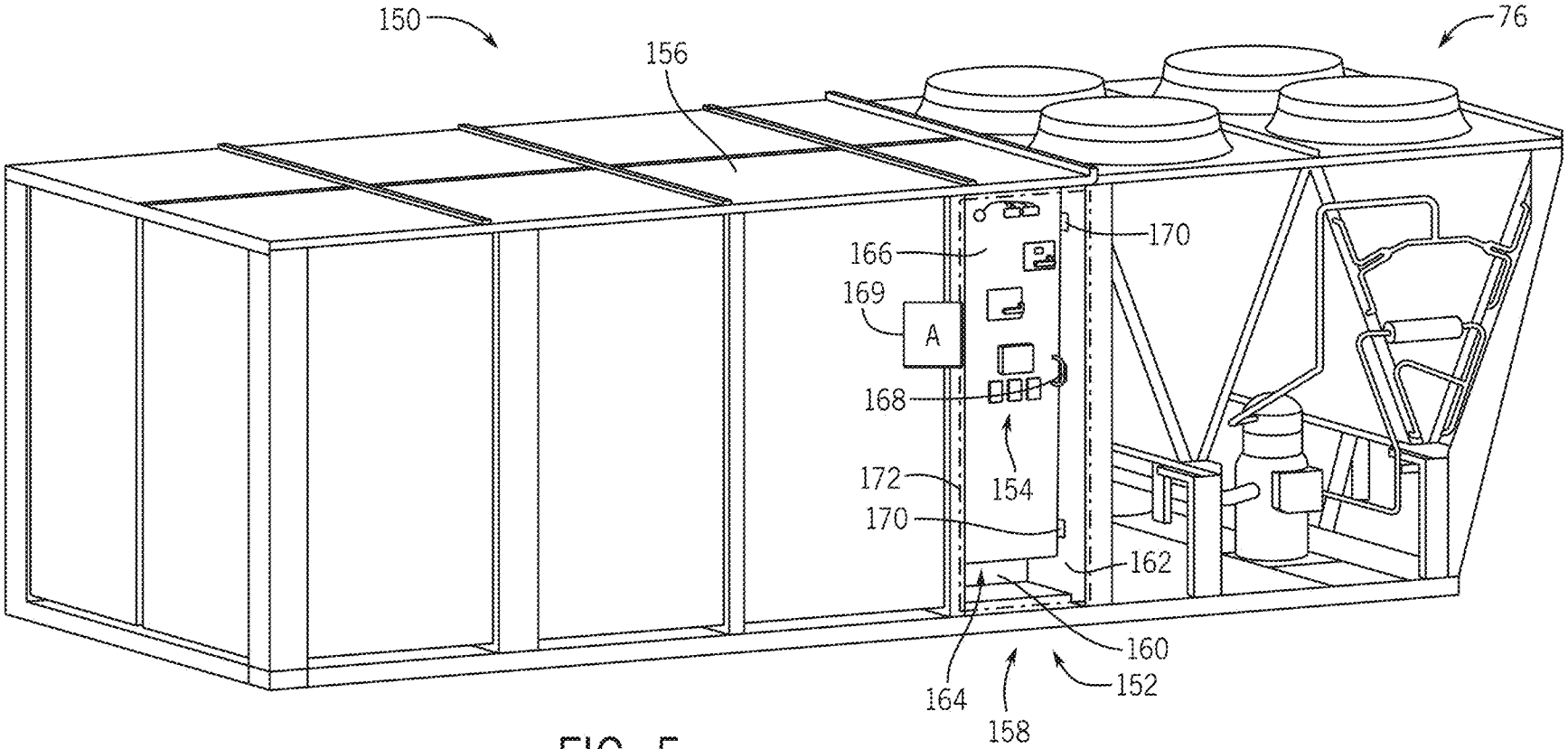
FIG. 5 is a perspective view of an embodiment of an HVAC unit having an electrical section, in accordance with an aspect of the present disclosure.

With this in mind, FIG. 5 is a perspective view of an embodiment of an HVAC unit 150 having an electrical section 152. The illustrated HVAC unit 150 includes an RTU, but features described herein may be implemented in any suitable HVAC unit 150, such as a split system or other packaged unit. The electrical section 152 includes various electrical components 154 configured to enable operation of the HVAC unit 150, such as control of the vapor compression system 72. Such electrical components 154 may include a low voltage component (e.g., a low voltage control component) and/or a high voltage component (e.g., a high voltage control component) to enable operation of the HVAC unit 150.

The electrical section 152 is formed or positioned within a housing 156 of the HVAC unit 150 adjacent to an exterior 158 of the HVAC unit 150 (e.g., an ambient environment) to facilitate access to the electrical components 154, such as by an operator, technician, or other user of the HVAC unit 150. The housing 156 may include a base wall 160 disposed adjacent to an interior of the housing 156. Certain electrical components 154, such as high voltage components, may be coupled to the base wall 160. The housing 156 may further include side walls 162 coupled to the base wall 160 to form a recess 164 within the housing 156. The electrical section 152 may include a panel 166 to which a remainder of the electrical components 154, such as low voltage components, may be coupled. In some implementations, the panel 166 may be movably coupled to the housing 156. For example, the panel 166 may be adjustably coupled to one of the side walls 162 to enable the panel 166 to be moved to various configurations or positions to expose the base wall 160 to the exterior 158 or to cover or occlude the base wall 160 from the exterior 158. In this way, the panel 166 may transition between a closed configuration, which may block access to the recess 164 of the housing 156 and to the base wall 160, and an open configuration, which may enable access to the recess 164 of the housing 156 and to the base wall 160. In some embodiments, the panel 166 may rotate relative to the housing 156, such as by pivoting about one of the side walls 162. In additional or alternative embodiments, the panel 166 may linearly translate relative to the housing 156, such as by sliding along one of the side walls 162. In further embodiments, the panel 166 may be easily decoupled from the housing 156. By way of example, the panel 166 may be configured to couple to the housing 156 via fasteners to move the panel 166 into the closed configuration, and the fasteners may be removed to decouple and remove the panel 166 from the housing 156, thereby moving the panel 166 into the open configuration.

In order to facilitate movement of the panel 166 relative to the housing 156, such as between the open configuration and the closed configuration, a handle 168 may be coupled to the panel 166. The handle 168 may extend away from the panel 166 and toward the exterior 158 of the HVAC unit 150 so that the handle 168 is more easily accessible. Moreover, the handle 168 has a geometric shape that enables a user to easily grasp the handle 168 and manually move the panel 166 with the handle 168. Additionally or alternatively, the panel 166 may be configured to automatically move relative to the housing 156. For instance, the panel 166 may include an actuator 169 communicatively coupled to a controller, such as the control panel 82. The controller may be configured to control the actuator 169 to cause the panel 166 to move relative to the housing 156 without manual actuation by the user.

Furthermore, a locking component 170 may be used to retain the panel 166 in the closed configuration. The locking component 170 may include a magnet configured to magnetically engage with the panel 166 (e.g., a corresponding magnet of the panel 166) to retain the panel 166 in the closed configuration. However, the magnet may disengage the panel 166 when enough force is imparted onto the panel 166 to move the panel 166 relative to the housing 156. Additionally or alternatively, the locking component 170 may include a latch that may physically engage with the panel 166 to retain the panel 166 in the closed configuration. The latch may be adjustable, such as manually by the user, to enable the panel 166 to move relative to the housing 156 into the open configuration. Indeed, the locking component 170 may include any suitable component or mechanism that releasably retains the position of the panel 166 in the closed configuration. That is, the locking component 170 maintains the position of the panel 166 in the closed configuration, but the locking component 170 may be released to enable adjustment of the panel 166 from the closed configuration to the open configuration.

The illustrated electrical section 152 is positioned adjacent to the condenser 76 of the HVAC unit 150. However, the electrical section 152 may be placed at any suitable location of the HVAC unit 150, such as within or external to the housing 156. Furthermore, in some embodiments, the panel 166 may be at least partially disposed within the recess 164. For example, the panel 166 may be positioned within the recess 164 of the housing 156 such that the electrical components 154 coupled to the panel 166 do not extend beyond the exterior 158 of the HVAC unit 150 in the closed configuration of the panel 166. Thus, a cover panel 172, shown in phantom lines in FIG. 5, may be coupled to the housing 156 to cover the electrical section 152 while the panel 166 is in the closed configuration in order to block exposure of the electrical section 152 to the exterior 158 of the HVAC unit 150 and the surrounding environment. The cover panel 172 may be removably coupled to the housing 156. For example, if access to the panel 166 is not desirable, the cover panel 172 may be coupled to the housing 156 to shield the electrical section 152 from the exterior 158, such as from dust and/or debris in the surrounding environment. However, if access to the panel 166 is desirable, the cover panel 172 may be decoupled from the housing 156 such that the panel 166 is exposed to the exterior 158 and is accessible to the user. In additional or alternative embodiments, the cover panel 172 may also be adjustably (e.g., rotationally, translatably) coupled to the housing 156 to enable the cover panel 172 to be moved without decoupling the cover panel 172 from the housing 156. For instance, the cover panel 172 may rotate and/or slide relative to the housing 156. Therefore, the cover panel 172 may provide adjustable coverage of the electrical section 152.

Figure 6:
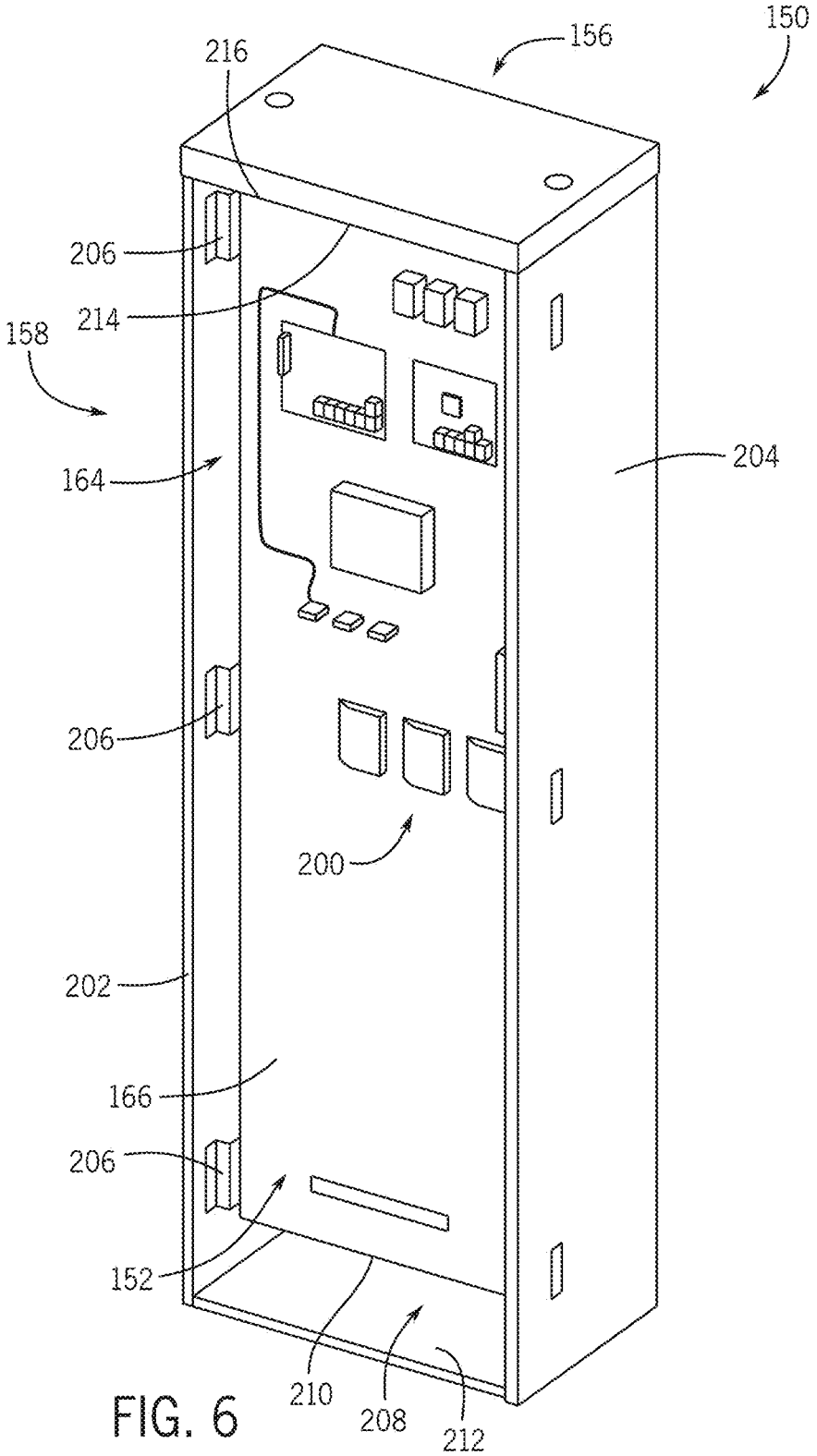
FIG. 6 is a perspective view of an embodiment of an electrical section of an HVAC unit having a panel in a closed configuration, in accordance with an aspect of the present disclosure.

FIG. 6 is a perspective view of an embodiment of the electrical section 152 positioned within the housing 156 of the HVAC unit 150. In particular, FIG. 6 illustrates the panel 166 of the electrical section 152 in the closed configuration with at least one low voltage component 200 (e.g., low voltage control component) coupled to the panel 166. For example, the low voltage component(s) 200 may be coupled to the panel 166 via a fastener, a weld, an adhesive, a tab, another suitable feature, or any combination thereof. In the closed configuration, an entirety of the low voltage component(s) 200 coupled to the panel 166 may be contained within the recess 164 to enable coupling of the cover panel 172 to the housing 156. For example, the cover panel 172 may be coupled to a first side wall 202 and/or to a second side wall 204 positioned opposite the first side wall 202, thereby covering the panel 166. Further, in the closed configuration, the panel 166 may engage the locking component 170 to retain the panel 166 in the closed configuration. By way of example, the panel 166 may be movably coupled to the first side wall 202, such as via hinges 206 configured to enable rotation of the panel 166 about the first side wall 202. Moreover, at least a portion of the locking component 170 may be coupled to the second side wall 204. The panel 166 may engage the second side wall 204 and the locking component 170 of the second side wall 204 to releasably secure the panel 166 to the second side wall 204 and retain the panel 166 in the closed configuration.

In the illustrated embodiment, a gap 208 (e.g., a space) is formed between a first edge 210 (e.g., a bottom edge) of the panel 166 and a first surface 212 (e.g., a bottom surface) of the housing 156 coupled to the side walls 202, 204. Accordingly, the panel 166 may be offset from the first surface 212 and therefore may not engage or abut with the first surface 212 to facilitate movement of the panel 166 relative to the housing 156. In some embodiments, certain components, such as wiring, cables, and the like, may extend through the gap 208 so as to extend from the panel 166 to the base wall 160. Similarly, a gap may be formed between a second edge 214 (e.g., a top edge) of the panel 166 and a second surface 216 (e.g., a top surface) of the housing 156 to facilitate movement of the panel 166 relative to the housing 156 and/or to enable components to extend from the panel 166 to the base wall 160. In additional or alternative embodiments, the first edge 210 of the panel 166 may engage or abut the first surface 212 of the housing 156 and/or the second edge 214 may engage or abut the second surface 216 such that no gaps are formed between the panel 166 and surfaces 212, 216.

It should be noted that the closed configuration of the panel 166 substantially blocks exposure of the base wall 160 to the exterior 158 of the HVAC unit 150 while also providing an air gap between the panel 166 and the high voltage component(s) in compliance with industry standards. In this way, the low voltage component(s) 200 coupled to the panel 166 may be accessible to the user, but access to at least one of the high voltage component(s) coupled to the base wall 160 may be substantially blocked. Thus, while the user is accessing the low voltage component (s) 200, such as for performing maintenance on the low voltage component(s) 200, the high voltage component(s) may remain operational and secured without interfering with the user access to the low voltage component(s) 200. To this end, the panel 166 may include a solid material to block any of the low voltage component(s) 200 from extending through the panel 166 toward the base wall 160 and the high voltage component(s) (e.g., into the air gap formed between the panel 166 and the high voltage component(s)). Such material of the panel 166 may also block any equipment of the user from extending through the panel 166 while the user is accessing the low voltage component(s) 200. By way of example, the panel 166 may be made of an acrylic material, a metallic material, a polymeric material, a composite material, another suitable material, or any combination thereof. For this reason, the closed configuration of the panel 166 may enable at least partial operation of the HVAC unit 150 during user access of the low voltage component(s) 200.

Figure 7:
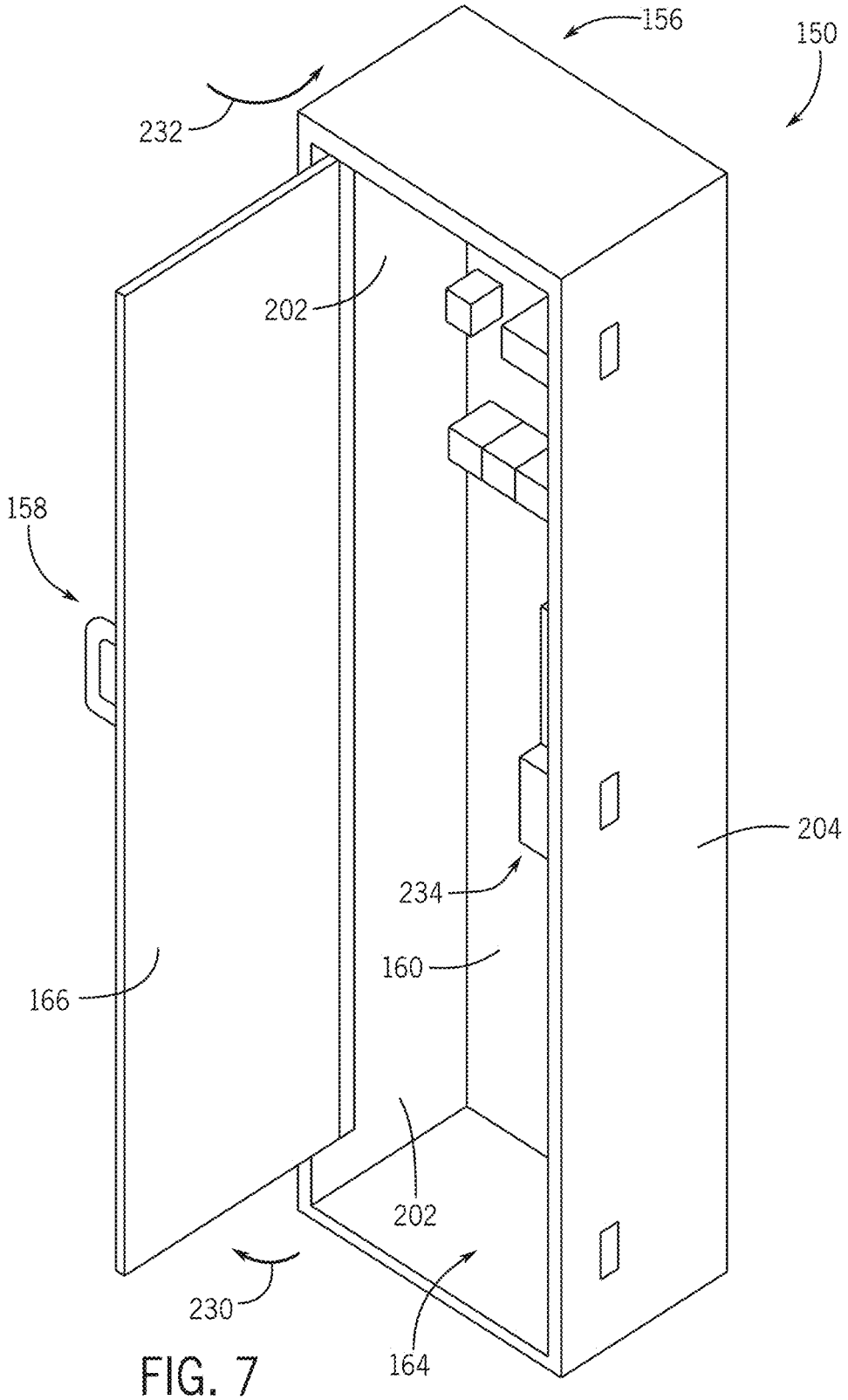
FIG. 7 is a perspective view of an embodiment of an electrical section of an HVAC unit having a panel in an open configuration, in accordance with an aspect of the present disclosure.

FIG. 7 is a perspective view of an embodiment of the electrical section 152 of FIG. 6, illustrating the panel 166 is in the open configuration. In the illustrated open configuration, the panel 166 is not engaged with the second side wall 204. By way of example, the panel 166 is rotated from the closed configuration in a first direction 230 about the first side wall 202 and away from the recess 164 of the housing 156. As a result, the panel 166 may at least partially extend out of the recess 164 and beyond the exterior 158 of the HVAC unit 150 in the open configuration, and at least a portion of the low voltage component(s) 200 of the panel 166 may be positioned at the exterior 158 of (e.g., external to) the HVAC unit 150. Furthermore, in the illustrated open configuration, the panel 166 may abut the first side wall 202, which may block further rotation of the panel 166 in the first direction 230. The panel 166 may also be moved from the open configuration to the closed configuration via rotation toward the recess 164 of the housing 156 in a second direction 232, opposite the first direction 230.

In the open configuration of the panel 166, the base wall 160 is exposed to the exterior 158. At least one high voltage component 234 (e.g., high voltage power component) may be coupled to the base wall 160 and may therefore be exposed to the exterior 158 in the open configuration of the panel 166. For instance, the panel 166 may be moved to the open configuration to substantially expose the recess 164 to the exterior 158. As such, the user may access the high voltage component(s) 234, such as for maintenance, when the high voltage component(s) 234 are not in operation.

In certain embodiments, the base wall 160 may be fixedly coupled to the side walls 202, 204. That is, the base wall 160 may not substantially move relative to the housing 156 of the HVAC unit 150. Moreover, the base wall 160 may extend substantially perpendicular to the side walls 202, 204. Accordingly, the recess 164 formed by the base wall 160 and the side walls 202, 204 may have a rectangular prismatic geometry. In additional or alternative embodiments, the base wall 160 may be oriented relative to the side walls 202, 204 in any suitable manner to form a recess having any suitable geometry.

It should be noted that the panel 166 may also be moved to a configuration between the open configuration and the closed configuration described herein. As an example, the panel 166 may be moved to a partially open configuration that exposes most of the recess 164 of the housing 156 to the exterior 158 while covering a remainder of the recess 164 of the housing 156 from the exterior 158. The panel 166 may alternatively be moved to a partially closed configuration that blocks most of the recess 164 of the housing 156 from the exterior 158 while exposing a remainder of the recess 164 of the housing 156 to the exterior 158. In further embodiments, the panel 166 may include various sections that may be moved relative to one another. By way of example, a first section of the panel 166 may be moved (e.g., rotated relative to the first side wall 202) into the open configuration to expose a portion of the base wall 160, while a second section of the panel 166 may remain in the closed configuration to cover a remainder of the base wall 160. Thus, different sections of the panel 166 may be moved independently of one another. Indeed, the panel 166 may be moved to any suitable configuration to expose or cover different parts of the base wall 160.

Figure 8:
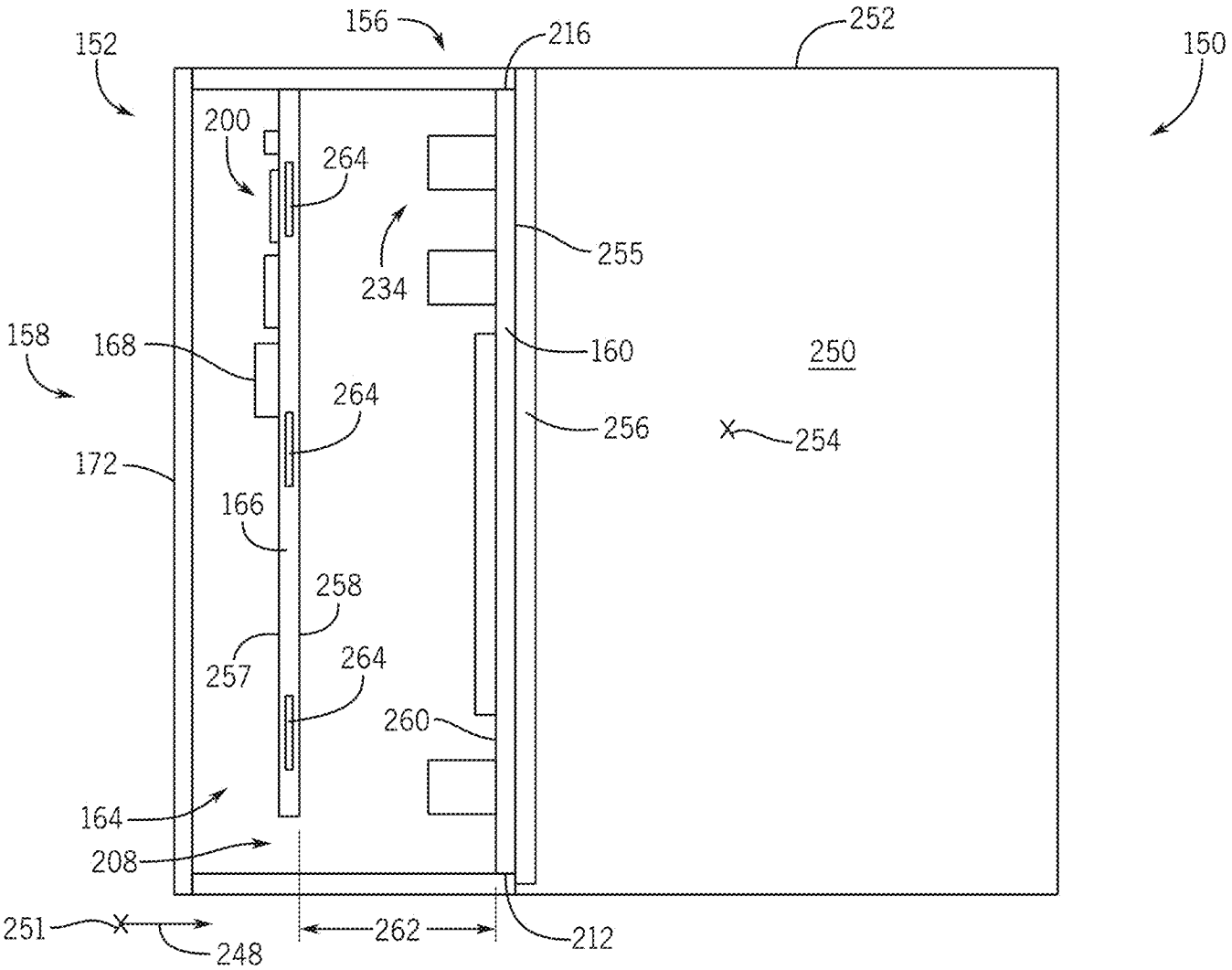
FIG. 8 is a side view schematic diagram of an embodiment of an HVAC unit with an electrical section having a panel in a closed configuration, in accordance with an aspect of the present disclosure.

FIG. 8 is a side view schematic diagram of an embodiment of the HVAC unit 150, illustrating the panel 166 of the electrical section 152 is in the closed configuration. As shown in FIG. 8, the base wall 160 and the panel 166 may be substantially parallel with one another in the closed configuration. In addition, the base wall 160 and the panel 166 are offset from one another along a lateral axis 248 of the HVAC unit 150. Accordingly, the electrical section 152 may generally extend along the lateral axis 248 toward an interior 250 of the HVAC unit 150 rather than along a longitudinal axis 251 of the HVAC unit 150. For this reason, a length of the HVAC unit 150 may not be substantially increased to accommodate the positioning of the low voltage component(s) 200 and the high voltage component(s) 234 in the disclosed arrangement. Instead, the electrical section 152 may extend toward the interior 250 to a plenum or chamber 252 of the HVAC unit 150. For instance, the plenum 252 may be modified to accommodate the electrical section 152 without substantially increasing a width of the HVAC unit 150. Accordingly, the electrical section 152 may be installed into the housing 156 without substantially increasing a size or a physical footprint of the HVAC unit 150.

During operation of the HVAC unit 150, air (e.g., supply air) may flow through the plenum 252, such as in an air flow direction 254. A first surface 255 of the base wall 160 may be exposed to or in contact with the flow of air. However, the base wall 160 and the electrical section 152 may be insulated from the plenum 252. That is, heat transfer, such as convection caused by the flow of air through the plenum 252, may be substantially blocked between the electrical section 152 and the plenum 252. For instance, the base wall 160 may include an insulation material, such as an acrylic material, a polymer material (e.g., polyvinyl chloride), a fibrous (e.g., carbon fibrous) material, another suitable material, or any combination thereof, to block heat transfer between the base wall 160 and the plenum 252. Additionally or alternatively, an additional component, such as additional insulation material or layer 256, may separate the base wall 160 from the plenum 252. Similarly, the cover panel 172 may block heat transfer between the electrical section 152 and the exterior 158 of the HVAC unit 150. In this way, while the panel 166 is in the closed configuration and the cover panel 172 is coupled to the housing 156, the electrical section 152 may be thermally isolated (e.g., substantially thermally isolated) from both the plenum 252 and the exterior 158.

In the illustrated electrical section 152, the low voltage component(s) 200 may be coupled to an exterior surface 257 (e.g., externally-facing surface) of the panel 166. In this manner, the low voltage component(s) 200 may be outwardly facing relative to the interior 250 of the housing 156 in the closed configuration of the panel 166. Additionally, in the closed configuration of the panel 166, an interior surface 258 of the panel 166 may be offset from a second surface 260 of the base wall 160 to define or form an air gap 262 therebetween. The air gap 262 may physically, thermally, and/or electrically separate the low voltage component(s) 200 from the high voltage component(s) 234. For instance, the low voltage component(s) 200 may be positioned on a side of the panel 166 opposite the air gap 262 and may be isolated from (e.g., does not extend into) the air gap 262. As a result, the operation of the low voltage component(s) 200 may not substantially affect the operation of the high voltage component(s) 234. For example, the air gap 262 may measure to be approximately eight inches (21 centimeters), 10 inches (25 centimeters), or one foot (30 centimeters) or more, to separate the low voltage component(s) 200 from the high voltage component(s) 234.

The panel 166 may include latching components 264 that may engage the corresponding latching components (e.g., the locking component 170 of FIG. 5) of the second side wall 204 in the closed configuration of the panel 166. Although the illustrated panel 166 includes three latching components 264, additional or alternative panels 166 may include any suitable number of latching components 264, such as one latching component 264, two latching components 264, or more than three latching components 264, to releasably secure the panel 166 to the second side wall 204.

Additionally, the base wall 160 may be coupled to the surfaces 212, 216 of the housing 156. In this way, the surfaces 212, 216 may further secure the base wall 160 to the housing 156. As such, the gap 208 separating the panel 166 from the first surface 212 may facilitate movement of the panel 166 relative to the housing 156, and the coupling between the base wall 160 and the surfaces 212, 216 may substantially block movement of the base wall 160 relative to the housing 156.

Although the low voltage component(s) 200 are coupled to the panel 166 and the high voltage component(s) 234 are coupled to the base wall 160 in the illustrated HVAC unit 150, in additional or alternative embodiments, the low voltage component(s) 200 may be coupled to the base wall 160 and/or the high voltage component(s) 234 may be coupled to the panel 166. That is, at least some of the high voltage component(s) 234 may be positioned more adjacent (e.g., closer) to the exterior 158 of the HVAC unit 150 and the low voltage component(s) 200 may be positioned more adjacent (e.g., closer) to the interior 250 of the HVAC unit 150. Indeed, the base wall 160, the panel 166, or both, may have a mixture of low voltage component(s) 200, high voltage component(s) 234, and/or any suitable components coupled thereto.

The present disclosure may provide one or more technical effects useful in the operation of an HVAC system. For example, the HVAC system may include an electrical section having low voltage components (e.g., control components) and high voltage components (e.g., power components) that work in conjunction with one another to operate the HVAC system. The HVAC system may have a housing that includes a wall and a panel. The panel may be positioned closer to an exterior of the HVAC unit compared to the wall, such as relative to a lateral axis (e.g., a width) of the HVAC system, but the wall may be substantially aligned with the panel along a longitudinal axis (e.g., a length) of the HVAC system. The high voltage components may be coupled to the wall, and the low voltage components may be coupled to the panel. In this way, the low voltage components may be substantially aligned with the high voltage components along the longitudinal axis, such that the length of the HVAC system may not be substantially increased to accommodate the electrical section. As a result, a cost associated with a manufacture of the HVAC system may be reduced. Moreover, the panel may be adjustable relative to the wall to selectively access various components of the electrical section. For instance, in a closed configuration of the panel, the panel may block access to and exposure of the high voltage components, but the low voltage components may be accessible to a user. In an open configuration of the panel, the panel may provide access to and exposure of the high voltage components, and the high voltage components may be accessible to the user. Therefore, the electrical section is adjustable to selectively and individually access the low voltage components and the high voltage components. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and/or air conditioning (HVAC) unit, comprising:

a housing comprising a base wall;

a first electrical component coupled to the base wall;

a panel movably coupled to the housing, wherein the panel is configured to transition between a closed configuration that defines an air gap between the panel and the base wall and that blocks access to the first electrical component and an open configuration that enables access to the first electrical component; and a second electrical component coupled to the panel, wherein the second electrical component is disposed on a side of the panel, and the side of the panel faces away from the air gap in the closed configuration of the panel.

2. The HVAC unit of claim 1, wherein the first electrical component is a high voltage power component, and the second electrical component is a low voltage control component.

3. The HVAC unit of claim 1, wherein the panel is coupled to a first side wall of the housing via a hinge, and the panel is configured to rotate about the hinge and away from the base wall to enable access to the first electrical component.

4. The HVAC unit of claim 3, wherein the panel is configured to be releasably secured to a second side wall in the closed configuration.

5. The HVAC unit of claim 4, comprising a magnet configured to releasably secure the panel to the second side wall in the closed configuration.

6. The HVAC unit of claim 1, comprising a handle coupled to the panel on the side of the panel.

7. The HVAC unit of claim 1, comprising a cover panel configured to couple to the housing with the panel in the closed configuration to block access to the panel.

8. The HVAC unit of claim 1, wherein the base wall is fixedly coupled to a plurality of side walls of the housing.

9. The HVAC unit of claim 1, wherein the panel blocks exposure of the second electrical component to the air gap in the closed configuration.

10. A heating, ventilation, and/or air conditioning (HVAC) unit, comprising:

a base wall coupled to a side wall;

a high voltage power component coupled to the base wall;

a panel coupled to the side wall, wherein the panel is configured to transition between a closed configuration that occludes the base wall from an exterior of the HVAC unit and an open configuration that exposes the base wall to the exterior of the HVAC unit, an air gap spans between the panel and the high voltage power component in the closed configuration of the panel, the panel comprises a first side that is exposed to the air gap in the closed configuration of the panel, and the panel comprises a second side, opposite the first side, that is isolated from the air gap in the closed configuration; and a low voltage control component coupled to the panel, wherein the low voltage control component is disposed on the second side of the panel.

11. The HVAC unit of claim 10, comprising a hinge coupling the panel to the side wall, wherein the panel is configured to rotate about the hinge to transition between the closed configuration and the open configuration.

12. The HVAC unit of claim 10, wherein the panel extends generally parallel to the base wall in the closed configuration.

13. The HVAC unit of claim 10, wherein the base wall extends generally perpendicular to the side wall.

14. The HVAC unit of claim 10, wherein the base wall comprises an insulation material.

15. A heating, ventilation, and/or air conditioning (HVAC) system, comprising:

a plurality of walls forming a recess in a housing of the HVAC system;

high voltage power components coupled to a first wall of the plurality of walls;

a panel rotatably coupled to a second wall of the plurality of walls, wherein the panel is configured to rotate between a closed configuration that blocks access to an interior of the recess and an open configuration that enables access to the interior of the recess, the panel is offset from the first wall to form an air gap between the panel and the first wall in the closed configuration of the panel, the panel comprises an interior surface that faces the air gap in the closed configuration of the panel, and the panel comprises an exterior surface that faces away from the air gap in the closed configuration of the panel; and low voltage control components coupled to the exterior surface of the panel.

16. The HVAC system of claim 15, wherein the panel is configured to at least partially extend out of the housing in the open configuration.

17. The HVAC system of claim 15, comprising a handle coupled to the exterior surface of the panel.

18. The HVAC system of claim 15, wherein the high voltage power components extend within the air gap and toward the panel.

19. The HVAC system of claim 15, wherein the panel comprises a locking component configured to releasably secure the panel in the closed configuration.

20. The HVAC system of claim 15, wherein the plurality of walls is configured to engage a surface of the housing to form the recess, and the panel is offset from the surface to form a gap between the panel and the surface.

* * * * *